US008967686B2

(12) United States Patent
Rudhager et al.

(10) Patent No.: US 8,967,686 B2
(45) Date of Patent: Mar. 3, 2015

(54) FITTING ARRANGEMENT FOR A DOOR HANDLE

(75) Inventors: Peter Rudhager, Varberg (SE); Peter Nystrom, Varberg (SE)

(73) Assignee: Rudhager-Nystrom Design & Innovations AB (SE)

( * ) Notice: Subject to any disclaimer, the term of this patent is extended or adjusted under 35 U.S.C. 154(b) by 0 days.

(21) Appl. No.: 13/497,550

(22) PCT Filed: Sep. 21, 2010

(86) PCT No.: PCT/SE2010/000226

§ 371 (c)(1),
(2), (4) Date: Jun. 22, 2012

(87) PCT Pub. No.: WO2011/037510

PCT Pub. Date: Mar. 31, 2011

(65) Prior Publication Data

US 2012/0267907 A1 Oct. 25, 2012

(30) Foreign Application Priority Data

Sep. 23, 2009 (SE) ..... 0901226

(51) Int. Cl.

| | |
|---|---|
| ***E05B 3/00*** | (2006.01) |
| ***E05B 15/02*** | (2006.01) |
| ***E05B 3/04*** | (2006.01) |
| ***E05B 63/00*** | (2006.01) |

(52) U.S. Cl.

CPC . *E05B 15/02* (2013.01); *E05B 3/04* (2013.01); *E05B 63/006* (2013.01)

USPC ..... 292/348; 292/353; 292/357; 292/359; 292/251.5

(58) Field of Classification Search

USPC ..... 70/276, 413, 461; 292/348, 356–359, 292/251.5, DIG. 53, DIG. 54

See application file for complete search history.

(56) References Cited

U.S. PATENT DOCUMENTS 250,588 A * 12/1881 Shorland ..... 292/358
325,545 A * 9/1885 Keating ..... 292/348

(Continued)

FOREIGN PATENT DOCUMENTS

DE 1125808 B 3/1962
EP 0430185 A2 6/1991

(Continued)

OTHER PUBLICATIONS

International Search Report for PCT/SE2010/000226, Completed by the Swedish Patent Office on Dec. 30, 2010, 3 Pages.

*Primary Examiner* — Kristina Fulton
*Assistant Examiner* — Thomas Neubauer
(74) *Attorney, Agent, or Firm* — Brooks Kushman PC

(57) ABSTRACT

A fitting arrangement for mounting a handle to a door, the door having a predetermined thickness and an interior lock chamber. A rod interconnects two handles extending through the lock chamber. A washer or cover plate is connected to an adjustment device for adaptation of the position of the washer or cover plate to the predetermined thickness. The fitting arrangement includes an adjustment device having a coupling with a magnet for fixing of the adjustment device on the lock chamber. The adjustment device has an outer part intended for securing on the washer or cover plate and an inner part with the magnet, the outer and the inner parts being adjustably connected to one another by the intermediary of a thread union.

9 Claims, 5 Drawing Sheets

(56) References Cited

U.S. PATENT DOCUMENTS

| | | | | | |
|---|---|---|---|---|---|
| 498,244 | A | * | 5/1893 | Deibert | 292/358 |
| 644,559 | A | * | 2/1900 | Lewis | 292/348 |
| 1,486,824 | A | * | 3/1924 | Anderson | 292/352 |
| 2,188,532 | A | * | 1/1940 | Dominguez | 70/108 |
| 2,621,065 | A | * | 12/1952 | Ström | 292/353 |
| 2,656,210 | A | * | 10/1953 | Kump | 292/353 |
| 3,508,777 | A | * | 4/1970 | McBurnie | 292/254 |
| 5,236,235 | A | * | 8/1993 | Gustafson et al. | 292/357 |
| 5,944,368 | A | * | 8/1999 | Hastings | 292/251.5 |
| 6,869,115 | B2 | * | 3/2005 | Shen | 292/357 |
| 2007/0170731 | A1 | * | 7/2007 | Shen et al. | 292/348 |
| 2008/0116699 | A1 | * | 5/2008 | Karcher et al. | 292/336.3 |

FOREIGN PATENT DOCUMENTS

| | | | |
|---|---|---|---|
| EP | 1111164 | A1 | 6/2001 |
| GB | 130843 | A | 8/1919 |
| GB | 161069 | A | 4/1921 |
| WO | 2005047627 | A1 | 5/2005 |
| WO | 2009016174 | A2 | 2/2009 |

* cited by examiner

FITTING ARRANGEMENT FOR A DOOR HANDLE

CROSS-REFERENCE TO RELATED APPLICATION

This application is the U.S. national phase of PCT Appln. No. PCT/SE2010/000226 filed Sep. 21, 2010, which claims priority to Swedish application 0901226-1 filed on Sep. 23, 2009, the disclosures of which are incorporated in their entirety by reference herein.

TECHNICAL FIELD

The present invention relates to an arrangement for fitting a locking device in an openable and closable element of a predetermined thickness, such as a door or a window, there being disposed interiorly in the element a lock chamber through which extends a rod with a handle on either side of the element, and there being disposed between each handle and the element a washer or a cover plate through which the rod also extends, and the rod being, in response to the predetermined thickness, insertable to a greater or lesser extent in an aperture in at least one of the handles and is fixable there by means of a adjustable coupling.

BACKGROUND ART

In the fitting of handle arrangements of the traditional type, it has previously been common practice that the rod which extends through the door or the window must be adapted in length, i.e. often cut, depending upon the thickness of the door or the window. In addition, those washers or cover plates through which the rod extends have normally been mounted in place using through-going screws which have been cut to the intended length depending upon the thickness of the door or the window. Such a detailed adaptation of the components included in the handle arrangement have often proved to be complicated and time-consuming.

Publication WO 2005/047627 discloses a handle arrangement where the rod which extends through the door or the window has an adjustable coupling by means of which one end of the rod is variably fixable in a handle.

According to this document, the handle has an insertion opening for accommodating the above-mentioned rod, which, on its free end, is provided with a grooving for cooperation with a locking element disposed in the opposing handle in the insertion opening.

The locking element is designed as a part of an insertion sleeve which is insertable in the aperture of the handle. For ensuring a locking engagement between the locking element of the insertion sleeve and the grooving of the rod, there is provided in the handle a threaded opening with a grub screw.

Granted, this construction permits adjustment of the handle proper in response to the thickness of the door or the window, but does not permit a corresponding simple fitting of the washers or cover plates which are normally provided on both sides of the door or the window and through which the rod of the handle extends.

A corresponding adjustable coupling is also shown in WO 2009/016174. This adjustable coupling is not based on the use of grooves or locking teeth but rather on a "jammed draw effect" in an obliquely inclined annular spring which surrounds the rod which extends between the two handles.

Further examples of adjustable couplings of the type in question here are disclosed in GB 161 069 and DE 1 125 808.

The above considered prior art technology displays numerous embodiments showing how the distance between two handles may be adapted to the thickness of the door or the window on which the handles are fitted. On the other hand, it is not apparent how a corresponding adaptation is to take place in the fixing of the washers or cover plates which are normally disposed on both sides of the door or the window.

Problem Structure

The present invention has for its object to design the arrangement intimated by way of introduction so that is also permits adjustable fixing of both of the washers or cover plates which are placed on both sides of the door or the window. The present invention further has for its object to design the arrangement such that adjustment may take place rapidly and simply without the need for measurement tools and at low cost. Finally, the present invention also has for its object to design the arrangement so that it may simply be dismantled and refitted.

Solution

The objects forming the basis of the present invention will be attained if the arrangement disclosed by way of introduction is characterised in that the washer or the cover plate is connected to an adjustment device for adaptation of the position of the washer or the cover plate to the predetermined thickness and that the adjustment device and the lock chamber are interconnectable to one another by the intermediary of a coupling.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENT

The present invention relates in general to an arrangement in an openable and closable element such as a door, hatch, window or the like. However, for the sake of simplicity the present invention will only be described with reference to use together with a door.

Figure 1:
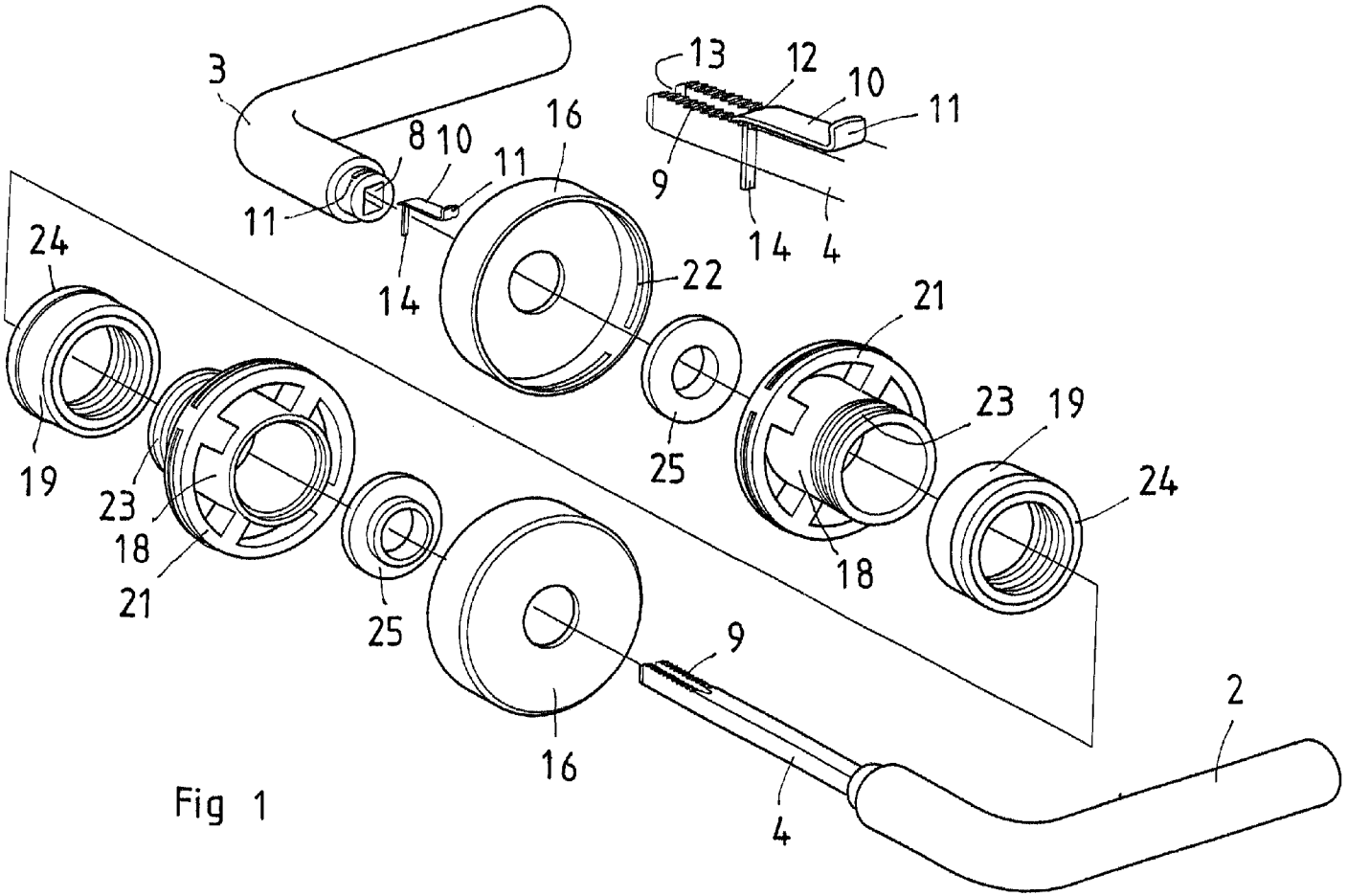
FIG. 1 is an exploded view of the components included in the arrangement according to the present invention in a first embodiment.
Figure 2:
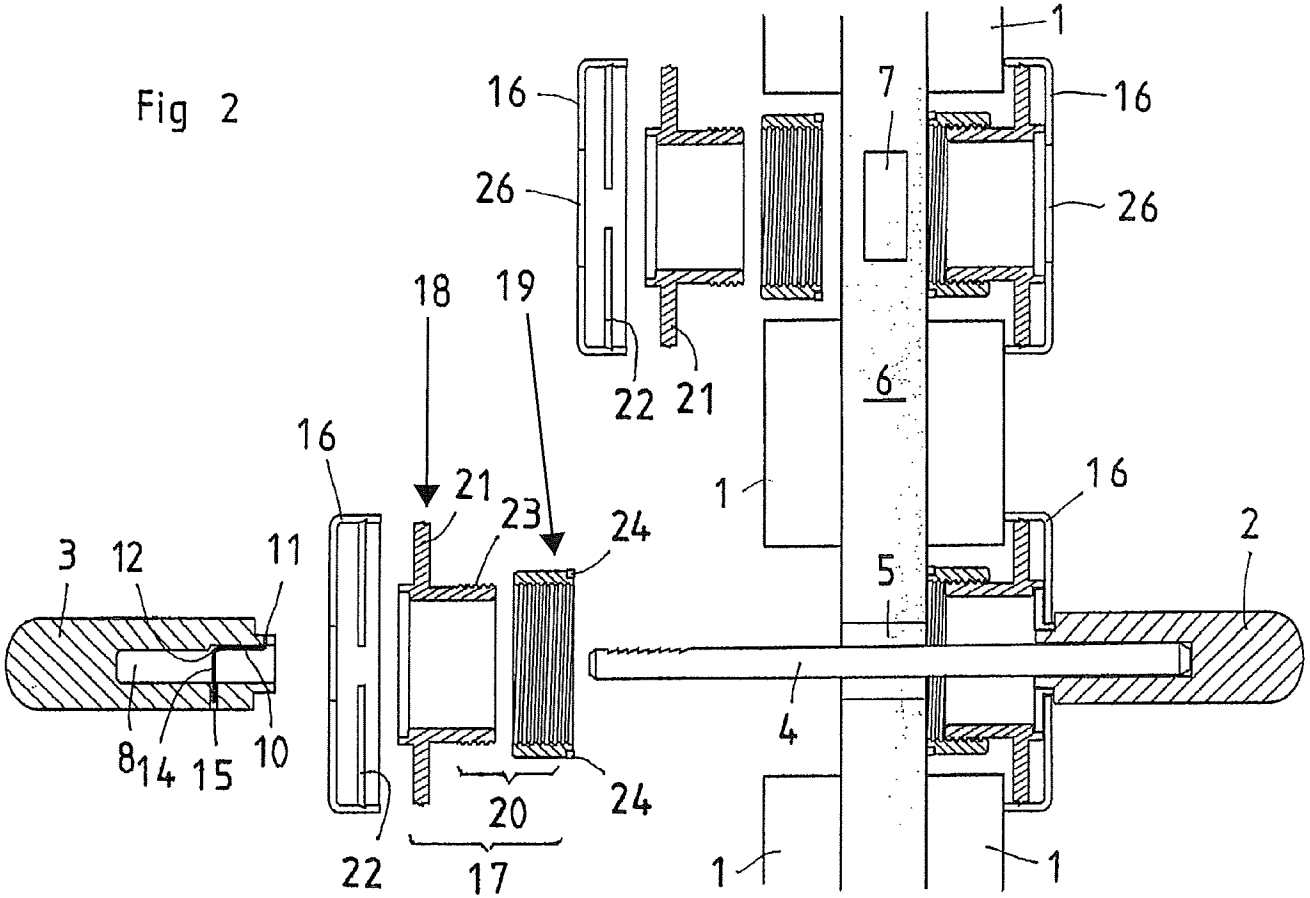
FIG. 2 is a partly exploded view together with a section taken through a door or a window of the components illustrated in FIG. 1.
Figure 3:
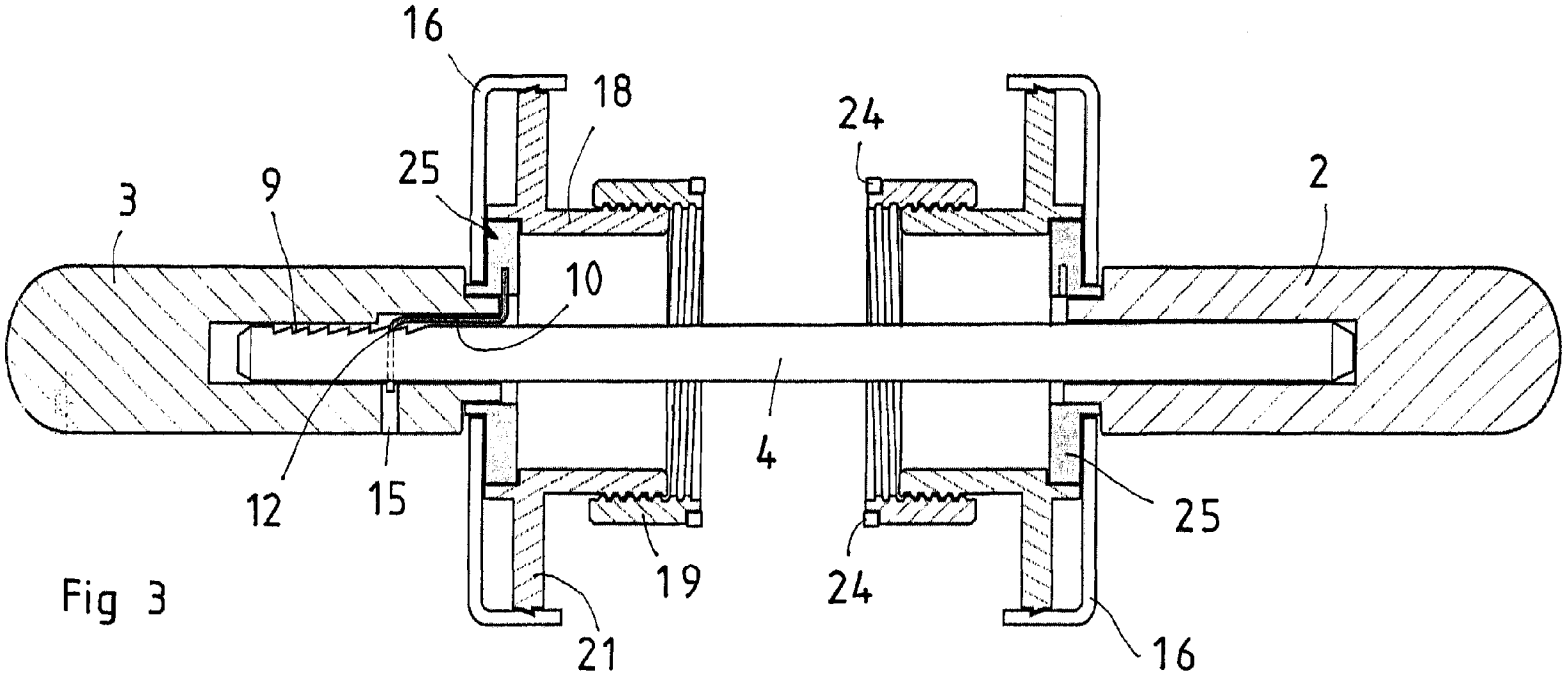
FIG. 3 shows the embodiment according to FIGS. 1 and 2 in the assembled state.

Referring to the Drawings, FIGS. 1-3 show a first embodiment of the arrangement according to the present invention, and it will be apparent from FIG. 2 that, on one side of a door 1, there is disposed a first handle 2 while on the opposing side of the door there is disposed a second handle 3. Permanently secured in the first handle 2 is a rod 4 of non-rotational symmetric cross section, for example a rectangular or square cross section. As a result of its design and configuration, the rod 4 makes a rotational interconnection of the two handles 2 and 3 but also constitutes a connection between the handles and a corresponding rotary portion 5 in a lock chamber 6 which is disposed countersunk in a corresponding recess in the door. It should be noted that the lock chamber 6 may have varying dimensions, also in the thickness direction of the door. It will further be apparent from FIG. 2 that the lock chamber has a dead bolt 7 which is operable under the action of a key-activated lock. The dead bolt which is operated under the action of the handles 2 and 3 and the rotary portion 5 is not illustrated in FIG. 2.

Concerning the door 1, it should further be mentioned that the left-hand side of the door in the FIG. 2 constitutes the inside of the door if the door is an outer entrance door. The reason for this will be disclosed in greater detail below.

As was mentioned by way of introduction, the door may be of varying thickness where the variation range may amount to one or a couple, possibly three centimeters.

The rod 4 which is permanently secured in the first handle 2 on the outside of the door is of such a length that it is sufficient even for a door of maximum thickness. In practice, the varying thickness of the door entails that the projection of the rod 4 outside the outer surface of the door 1 will be lesser the thicker the door is and greater the thinner the door. In order to make possible such a varying projection of the rod 4, the handle 3 disposed on the inside of the door displays an accommodation space 8 in which the left-hand end of the rod in FIG. 1 is insertable. The accommodation space 8 has a profile which corresponds to the cross section of the rod 4, whereby a non-rotary interconnection is realised between the rod 4 and the handle 3.

In order to make for a simple fitting of the handle arrangement according to the present invention, the rod 4 and the handle 3 have a coupling which is capable of compensating for different lengths of projection for the rod 4 on the outside of the door, i.e. the insertion length in the accommodation space 8. Further, the coupling is such that it is sufficient to insert the end of the rod in the accommodation space for a withdrawal of the rod, or alternatively a removal of the handle 3 from the door, to be prevented. The coupling between the rod 4 and the handle 3 may thereby be considered as an adjustable one-way coupling.

The coupling between the rod 4 and the handle 3 includes, at the free end region of the rod 4, a series of transverse grooves 9 where the individual grooves are designed as barbs with gripping edges directed in towards the door 1.

The coupling further includes a dead plate 10 which is disposed interiorly in the accommodation space 8 of the handle 3, or more precisely in a flared mouth region thereof. The dead plate 10 or the locking spring has, in its end edge turned to face to the left in FIG. 2, gently downwardly directed barbs which are designed to engage with the barbs on the grooving 9. The dead plate 10 is slightly resilient, which implies that, when the rod 4 is inserted in the accommodation space 8, the barbs of the dead plate 10 will be lifted and allow the passage of the barbs of the grooving 9 in order, when the movement ceases, to fall or spring down in an interspace between the barbs of the grooving 9 and lock against the locking edges of the barbs directed in towards the door.

In the handle 3, the dead plate 10 is fixed with a locking portion 11 which is accommodated and positionally fixed in a corresponding recess in the handle 3. As a result, withdrawal of the dead plate 10 from the handle is prevented.

FIG. 1, principally the upper part thereof, shows in perspective an end region of the rod 4 and the dead plate 10. It will be apparent from the Figure that the end region of the rod has, on normal use, a vertical through-going slot 13 with grooving 9 on both sides. The slot 13 serves the purpose of accommodating an operating portion 14 on the dead plate 10 and this operating portion is accessible by the intermediary of an opening 15 in the underside of the handle 3 (FIG. 2). The purpose of the operating portion 14 and the opening 15 is that, by an upwardly directed pressure of the operating portion 14, the locking edges 12 of the dead plate 10 may be lifted out of engagement with the barbs on the grooving 9 of the rod 4, whereby the handle may be simply dismounted from the door. Further, the operating portion 14 assists in preventing withdrawal of the dead plate 10 out of the opening 15.

The above described adjustable coupling between the rod 4 and the handle 3 makes for a convenient positional adaptation of the handles 2 and 3 in response to the thickness of the door 1, and also a convenient fitting and removal of the handles.

As will be apparent from the Figures, there are provided, between the handles 2 and 3 and both opposing sides of the door, washers or cover plates 16 which conceal those openings which, from the opposing sides of the door, lead into the lock chamber 6. These washers or cover plates must also be able to be secured in the door or the lock chamber regardless of how thick the door is and regardless of the thickness of the lock chamber.

According to the present invention, the washers 16 which are placed one on either side of the door and through which the rod 4 extends have fixing means 17 by means of which the washers 16 may be secured in the lock chamber 6 regardless of how far inside the outer surfaces of the door the chamber is located. The fixing means 17 comprise an outer part 18 and an inner part 19, where the inner part 19 is turned to face in towards the lock chamber while the outer part 18 is turned to face out towards the washer 16. Between these outer and inner parts there is an adjustment device 20 by means of which the length of the fixing means 17 in the longitudinal direction of the rod 4 may be varied for adaptation to the thickness of the door 1 and the depth in to the lock chamber 6.

The fixing means 17 have, in their outer end, an annular flange 21 which, with a peripheral region, may be snapped or fixed into an inner groove 22 in the washer 16. The fixing of the flange 21 in the groove 22 is such that the union between them can transmit a torque.

The outer part 18 of the adjustment device 20 has a tubular section with an exterior thread 23 which may be brought into mesh with a corresponding thread interiorly in the inner part 19 formed as a sleeve. By threading the inner part 19 in relation to the outer part 18, the extent of the fixing means in the longitudinal direction of the rod 4 may be varied to such an extent that an adaptation to a large number of door thicknesses (and also thicknesses of the lock chamber) may be compensated for. The adjustment device 20 also has a calibration or indication which indicates which setting has been chosen.

For fixing the fixing means 17 on the door, the adjustment device 20 has, in its end facing towards the lock chamber 6, a coupling 24 which, in the illustrated embodiment, fixes the fixing means 17 on the lock chamber. The coupling 24 includes an annular magnet which adheres to the lock chamber 6.

In order for the coupling to have the maximum possibility of catering for stresses which, in addition to a pure tractive force away from the door, also include a displacement along the plane of the door or a jerking, i.e. a pressing of either handle up or down, it is important that the magnet 24 has as large a diameter and as large an abutment surface as possible against the lock chamber 6. For this reason, the inner part 19 of the adjustment device 20 is disposed externally on the outer part 18 and the coupling 24, in the embodiment under consideration an annular magnet, is disposed along the outer periphery of the inner part 19.

In FIGS. 1 and 3, there are shown journal members 25 interiorly in the washers 16 which serve for improving the journaling of the handles 2 and 3 in the washers or covering plates 16.

FIG. 2 also shows two different washers 16 placed vertically over one another and on either side of the door 1. The upper set of washers 16 is, in this Figure is intended to cover a keyhole for operating the dead bolt 7 and, for this reason, has openings 26 for allowing the passage of a key. It should also be mentioned that the upper and lower washers or covering plates 16 may be continuous and in the form of a tall and narrow covering plate, which often occurs on doors of older designs. In addition, the handles 2 and 3 may be placed uppermost and the lock lowermost in the vertical direction. These upper washers or cover plates 16 in the Figure are adjustably secured in the lock chamber 6 in total analogy with that described above.

Figure 4:
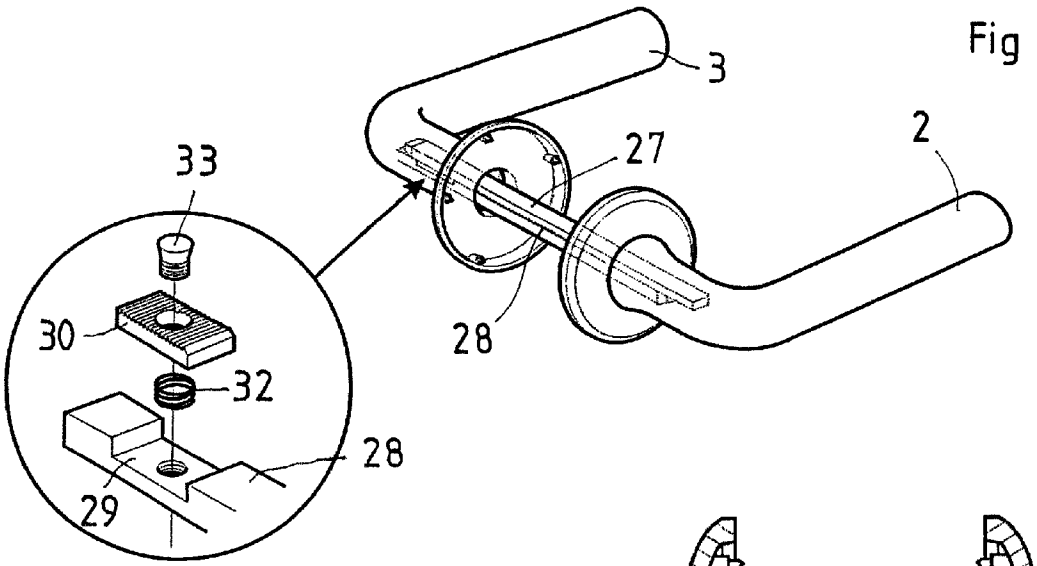
FIG. 4 is a perspective view of a slightly modified embodiment, the fixing means of the washers or cover plates having however been omitted.
Figure 5:
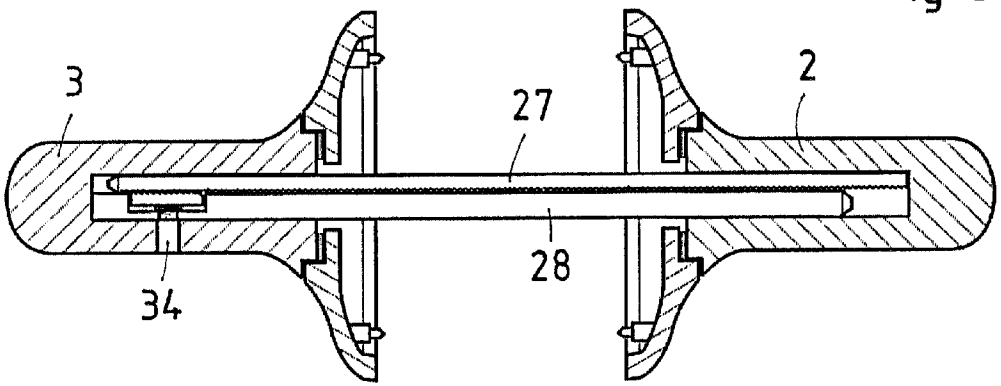
FIG. 5 is a section through the modified embodiment illustrated in FIG. 4 in the assembled state.

FIGS. 4 and 5 show a slightly modified embodiment. That which differs from the embodiment described in the foregoing is the fact that the above-mentioned rod 4 which interconnects both of the handles 2 and 3 has been replaced by an upper rod section 27 and a lower rod section 28.

In such instance, the lower rod section 28 is permanently secured in the handle 3 on the inside of the door while the upper rod section 27 is permanently secured in the other handle 2. The upper rod section 27 has, at least on its outer portion, a grooving which corresponds to the grooving 9 described above. In a recess 29 in the lower rod section 28, there is inlaid a locking body 30 which, on its upper side has a grooving 31 for locking cooperation with the corresponding grooving on the upper rod section 27. Between the locking body 30 and the bottom of the recess 29, there is a small spring 32 which lifts the locking body 30 into engagement with the upper rod section 27. Since the upper rod section 27 has a slightly speculated entry end (furthest to the left in FIG. 5), the upper rod section 27 may be slid into the handle 3 on the upper side of the lower rod section 28 and past the locking body 30 so that the two groovings may enter into mesh with one another. A withdrawal of the upper rod section 27 is impossible because of the design and direction of the groovings.

In order to open the above-described union, the locking body 30 has a screw 33 by means of which the locking body 30 may be urged down against the action of the spring 32 into abutment against the bottom of the recess 29 and thereby out of engagement with the downwardly facing grooving of the rod section 27. The screw 33 is accessible via an aperture 34 in the underside of the handle 3.

Figure 6:
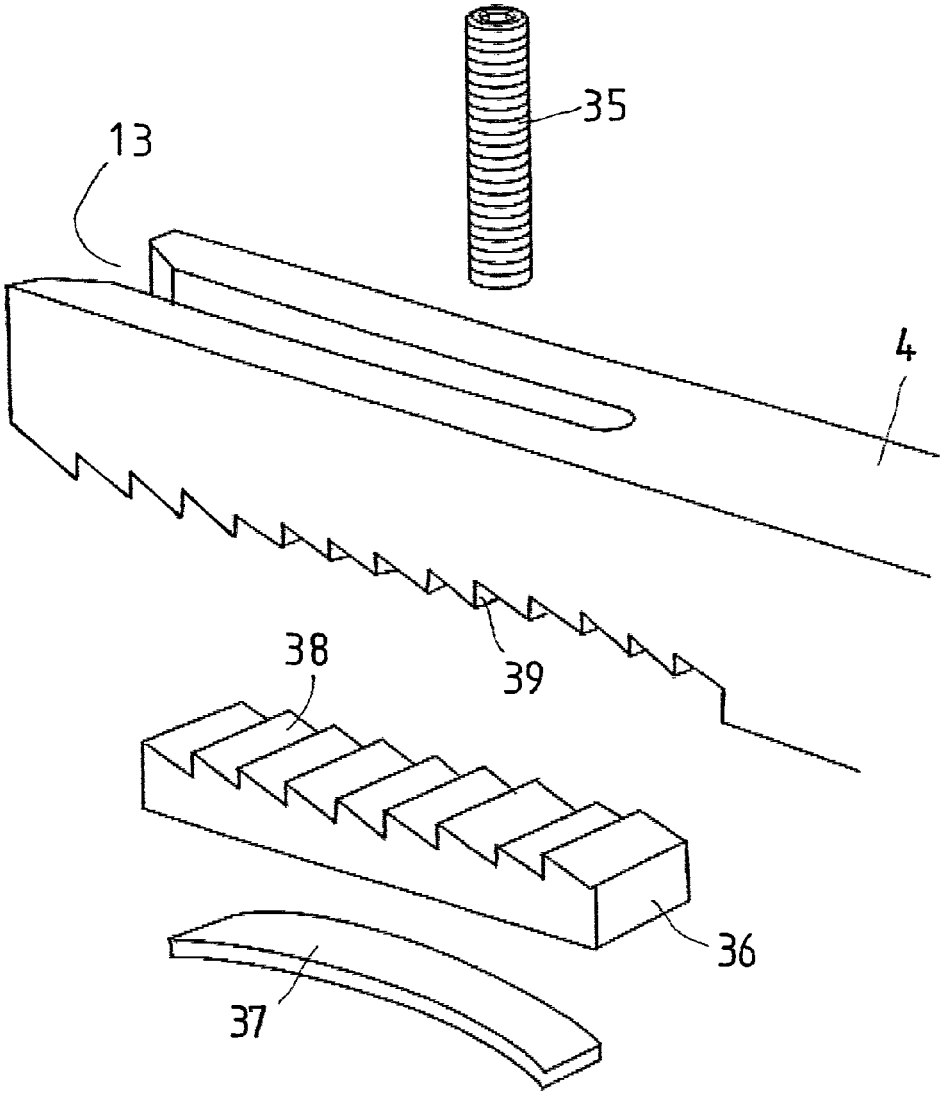
FIG. 6 shows in detail a perspective view of a further modified embodiment of the present invention.

FIG. 6 shows an alternative embodiment of the coupling which is adjustable and which unites the two handles on opposing sides of the door. In the Figure, the rod carries reference numeral 4 and it will be apparent that, like the embodiment according to FIGS. 1-3 has a longitudinal vertical slot 13 in which a screw 35 may be located. The screw 35 is threaded into a corresponding thread in the handle on the inside of the door. On the underside of the end portion of the rod 4 there is disposed a grooving 39 whose purpose is to cooperate with a corresponding grooving 38 on a locking body 36 which is lifted upwards against the rod 4 under the action of a spring 37 which is disposed interiorly in that opening in the handle which is provided for accommodating the end of the rod 4. On insertion of the rod 4 in the handle, its free end will be moved into the corresponding opening in the handle, whereupon the locking body 36, with its grooving 38, snaps past the grooving 39 of the rod. When the displacement has ceased, the teeth 38 or grooving of the locking body 36 will engage and lock with corresponding teeth or grooving 39 on the rod 4. On opening of this union, i.e. on dismounting of the rod 4, the screw 35 is threaded downwards into contact with the locking body 36 so that this is pressed down and out of engagement with the teeth or grooving 39 of the rod 4.

What is claimed is:

1. An arrangement for fitting a handle device in an openable and closable element of a predetermined thickness, such as a door or a window, there being disposed, interiorly in the element a lock chamber through which extends a rod with a handle at each side of the element, and there being disposed between each handle and the element a washer or cover plate through which the rod also extends, and the rod being, in response to the predetermined thickness, insertable a greater or lesser distance in an opening in at least one of the handles and fixable there by means of an adjustable coupling, wherein the rod comprises a series of transverse grooves on an outwardly-facing surface of the rod, and the rod is provided with a slot through the outside of the rod, wherein the adjustable coupling comprises a body adapted to be fixed to the at least one handle, the body having barbs adapted to engage with the grooves on both sides of the slot, wherein the washer or the cover plate is connected to an adjustment device for adaptation of a position of the washer or the cover plate to a predetermined thickness, the body having a first end, a second end, a first flange extending substantially perpendicularly from the first end and a second flange extending substantially perpendicularly from the second end in a direction opposite the first flange, the adjustment coupling being separate from the washer or the cover plate and being fixable by radially outwardly engaging with the handle and engaging radially inwardly with the rod, and that the adjustment device and the lock chamber are interconnectable to one another by an intermediary of a coupling.

2. The arrangement as claimed in claim 1, wherein the coupling includes at least one magnet provided for cooperation with a material of the lock chamber.

3. The arrangement as claimed in claim 1, wherein the adjustment device includes an outer part fixable in the washer or the cover plate and an inner part facing towards the lock chamber, the inner part on its surface facing towards the lock chamber being provided with a magnet and the inner and outer parts being, in a longitudinal direction of the rod adjustable in relation to one another by means of a thread union.

4. The arrangement as claimed in claim 3, wherein the outer part of the adjustment device is fixable on the washer or the cover plate.

5. The arrangement as claimed in claim 4, wherein the outer part of the adjustment device has or is connected to a rotation member for rotating the handle around an axis of the rod.

6. The arrangement as claimed in claim 5, wherein the rotation member has an annular flange which extends through a corresponding opening in the washer or the cover plate.

7. The arrangement as claimed in claim 1, wherein the adjustment device has an indication which shows for which door thickness adjustment has taken place.

8. The arrangement as claimed in claim 3, wherein the inner part of the adjustment device is of greater diameter than its outer part and partly surrounds it.

9. The arrangement as claimed in claim 3, wherein the outer part of the adjustment device has a radially projecting flange which is fixed interiorly in a corresponding space in the washer or the cover plate.

* * * * *